US009593292B2

(12) United States Patent
Carrick et al.

(10) Patent No.: US 9,593,292 B2
(45) Date of Patent: Mar. 14, 2017

(54) ENGINE LUBRICANTS CONTAINING A POLYETHER

(71) Applicant: The Lubrizol Corporation, Wickliffe, OH (US)

(72) Inventors: Virginia A. Carrick, Chardon, OH (US); Alvin E. Haas, Mentor, OH (US); Jonathan S. Vilardo, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/773,916

(22) PCT Filed: Feb. 17, 2014

(86) PCT No.: PCT/US2014/016669
§ 371 (c)(1),
(2) Date: Sep. 9, 2015

(87) PCT Pub. No.: WO2014/158435
PCT Pub. Date: Oct. 2, 2014

(65) Prior Publication Data

US 2016/0040090 A1 Feb. 11, 2016

Related U.S. Application Data

(60) Provisional application No. 61/778,645, filed on Mar. 13, 2013.

(51) Int. Cl.

| | |
|---|---|
| ***C10M 145/26*** | (2006.01) |
| ***C10M 161/00*** | (2006.01) |
| ***C10M 145/34*** | (2006.01) |
| ***C10M 145/36*** | (2006.01) |

(52) U.S. Cl.
CPC ..... *C10M 161/00* (2013.01); *C10M 145/34* (2013.01); *C10M 145/36* (2013.01); *C10M 2201/087* (2013.01); *C10M 2203/1006* (2013.01); *C10M 2207/028* (2013.01); *C10M 2209/084* (2013.01); *C10M 2209/104* (2013.01); *C10M 2209/105* (2013.01); *C10M 2209/107* (2013.01); *C10M 2215/223* (2013.01); *C10M 2215/28* (2013.01); *C10M 2219/022* (2013.01); *C10M 2219/046* (2013.01); *C10M 2223/045* (2013.01); *C10M 2229/041* (2013.01); *C10M 2229/051* (2013.01); *C10N 2220/021* (2013.01); *C10N 2230/10* (2013.01); *C10N 2230/12* (2013.01); *C10N 2230/18* (2013.01); *C10N 2230/24* (2013.01); *C10N 2230/45* (2013.01); *C10N 2240/10* (2013.01); *C10N 2240/30* (2013.01)

(58) Field of Classification Search
CPC ..... C10N 2240/10; C10N 2240/102
USPC ..... 508/579, 562
See application file for complete search history.

(56) References Cited

U.S. PATENT DOCUMENTS

| | | | | |
|---|---|---|---|---|
| 3,933,662 | A | 1/1976 | Lowe | |
| 6,001,780 | A | 12/1999 | Ho et al. | |
| 6,255,263 | B1 | 7/2001 | Ryan | |
| 6,340,659 | B1 * | 1/2002 | Kocsis | C10M 129/44 508/516 |
| 6,573,223 | B1 | 6/2003 | Vinci | |
| 7,816,414 | B2 * | 10/2010 | Holt | C10M 161/00 516/162 |
| 7,939,478 | B2 * | 5/2011 | Mayhew | C10M 163/00 508/185 |
| 8,071,515 | B2 * | 12/2011 | Kamano | C10M 141/06 508/280 |
| 8,163,680 | B2 * | 4/2012 | Palazzotto | C10L 3/10 508/110 |
| 8,288,326 | B2 | 10/2012 | Tobias et al. | |
| 9,175,237 | B2 * | 11/2015 | Verlinde | C10M 133/56 |
| 9,206,374 | B2 * | 12/2015 | Jukes | C10M 163/00 |
| 2003/0191031 | A1 | 10/2003 | Buzdygon et al. | |
| 2006/0166843 | A1 | 7/2006 | Rajewski et al. | |
| 2006/0217271 | A1 * | 9/2006 | Brown | C10M 159/12 508/165 |
| 2007/0142239 | A1 | 6/2007 | Boffa et al. | |
| 2007/0203031 | A1 * | 8/2007 | Bardasz | C10M 133/56 508/192 |
| 2012/0065112 | A1 | 3/2012 | Wardlow et al. | |
| 2012/0132166 | A1 | 5/2012 | Andoh et al. | |

FOREIGN PATENT DOCUMENTS

| | | |
|---|---|---|
| WO | 02/24843 | 3/2002 |
| WO | 2012/030537 | 3/2012 |
| WO | 2012/097026 | 7/2012 |

OTHER PUBLICATIONS

European Patent Office, International Search Report for PCT/US14/016669, mailed Jun. 10, 2014.
European Patent Office, Written Opinion of the International Search Authority for PCT/US14/016669, mailed Jun. 10, 2014.
European Patent Office, Written Opinion of the International Search Authority for PCT/US14/016669, mailed Mar. 16, 2015.
European Patent Office, International Preliminary Report on Patentability for PCT/US14/016669, mailed Jun. 29, 2015.

* cited by examiner

*Primary Examiner* — Ellen McAvoy
(74) *Attorney, Agent, or Firm* — David M. Shold; Christopher D. Hilker; Teresan W. Gilbert

(57) ABSTRACT

A lubricant comprising (a) an oil of lubricating viscosity; (b) a polyether of number average molecular weight 1000 to 10,000; said polyether comprising alkylene oxide monomer units, where the alkylene group contains 3 to 6 carbon atoms, and ethylene oxide monomer units; and (c) one or more anti-foam agents, where the lubricant has a sulfated ash content of less than about 0.7 percent, is useful for lubricating a stationary gas engine where the engine drives a compressor and where both the engine and the compressor are lubricated with the same lubricant.

10 Claims, No Drawings

ENGINE LUBRICANTS CONTAINING A POLYETHER

BACKGROUND OF THE INVENTION

The disclosed technology relates to a lubricant for a sump-lubricated internal combustion engine, especially such an engine that is fueled by natural gas. In certain embodiments the same lubricant is also used to lubricate a compressor that is driven by the engine.

Internal combustion engines may be fueled by a variety of liquid or gaseous fuels, including natural gas. While liquefied natural gas or compressed natural gas may sometimes be used to fuel small engines on vehicles, more typically natural gas is used to power large "stationary gas" engines that may be fueled by natural gas supplied directly from a gas wellhead, with minimal or no purification prior to consumption by the engine. Such gas may contain certain amounts of condensable hydrocarbons such as propane, butane, or heavier hydrocarbons, as well as water.

Natural gas engines are known and are described, for instance, in U.S. Pat. No. 8,288,326, Tobias et al., Oct. 16, 2012 (also published as WO 2001/028751, Mar. 10, 2011). The severe operating conditions and demands placed on a lubricant in such engines are described in paragraphs 0004 through 0010.

Stationary natural gas engines may be used to provide power to a variety of devices such as machinery, generators, or compressors. In certain embodiments, compressors powered thereby may be used to compress the natural gas itself. That is, natural gas derived from the wellhead may be divided into two streams, one of which is used to fuel the engine, and another is fed to a compressor, which may be a multiple-stage compressor. The resulting compressed gas may be used for any of a variety of purposes and delivered in a variety of ways, e.g., transportation via pipeline or storage in a receptacle for subsequent use or transportation. In some instances, the compressed gas may be injected into the ground at high pressure in order to facilitate recovery of petroleum from a well.

A natural gas compressor is typically a multi-stage screw compressor or a multi-stage reciprocating compressor, either of which may be lubricated by a lubricant supplied from a sump. Each stage of the compressor will typically be associated with one or more scrubbers to remove contaminants such as water or condensable hydrocarbons that may condense, e.g., after a previous compression and/or cooling stage. Such scrubbing is designed to not only remove contaminants from the final condensed gas stream, but also to prevent contaminants from fouling various components of the compressor and related equipment (such as valves, metering devices, pumps, and gears).

Both the stationary natural gas engine and a compressor powered thereby require lubrication, and it is found to be convenient in some instances to use the same lubricant for both pieces of equipment. This dual usage creates unusual demands on the lubricant, since the conditions encountered in an internal combustion engine may be quite different from those in a compressor. In particular, an engine lubricant will typically be exposed to a very harsh environment in terms of oxidation and nitration and consequently will be formulated to include high levels of high-soap detergents and antioxidants. A compressor, on the other hand, will typically involve the interaction of the lubricant with the hydrocarbons and other gaseous and liquefiable components of the natural gas, and compatibility therewith is required. In particular, a problem is sometimes observed in that water-containing condensate in a scrubber may mix with small amounts of lubricant oil (used for both the engine and the compressor) and may form an emulsion. This may lead to foaming and or plugging of lines and valves such as scrubber dump valves, as well as contamination of the lubricant itself and consequent deterioration in performance. It is desired to minimize or eliminate emulsion formation in such systems. Moreover, in the lubrication of stationary gas engines, with or without an associated compressor, it is desirable to provide a lubricant which reduces or eliminates combustion chamber (i.e., cylinder head and/or piston crown) deposits and reduces copper corrosion. A desirable lubricant may also exhibit good retention of basicity during use (as measured by retention of TBN) and slowed increase of acidity (as measured by retaining a low value of TAN).

Some or all of these benefits are provided by the lubricant of the disclosed technology.

PCT publication WO 2012/097026, Vilardo et al., Jul. 19, 2012, discloses a method for lubricating a sump-lubricated, spark-ignited engine comprising supplying to said engine a lubricant which comprises (a) an oil of lubricating viscosity; (b) a polyether fluidizer; and (c) a metal-containing detergent; said lubricant having a total phosphorus content of less than 0.06 percent by weight.

U.S. Pat. No. 3,933,662, Lowe, Jan. 20, 1976, discloses polyalkoxylated compounds combined with alkaline earth metal carbonates dispersed in a hydrocarbon medium to provide lubricating compositions of superior acid neutralizing capability and rust inhibition in internal combustion engines. Other additives may be present including ashless dispersants such as succinimides. The internal combustion engine tested is a Sequence IIB engine.

U.S. Pat. No. 6,001,780, Ho et al., Dec. 14, 1999, discloses ashless lubricating oil formulation for natural gas engines. Included is an untreated polyalkylene or polyalkenyl succinimide dispersant and a borated succinimide dispersant. The polyalkylene or polyalkenyl group may be derived from polyisobutene and may contain at least about 20 wt. % of a methylvinylidene isomer. Among other additive components are demulsifiers such as polyoxyethylene alkyl ether; rust inhibitors may also be nonionic polyoxyethylene surface active agents.

U.S. Publication 2006-0166843, Rajewski et al., Jul. 27, 2006, disclose polymeric additives for compressor lubricants that can reduce the amount of lubricant carryover as mist in compressed gas from the discharge side of the compressor. Optional lubricants include dispersants, detergents, corrosion inhibitors, etc. The lubricant may contain a carboxylate ester, polyalkylene glycol.

U.S. Publication 2007-0142239, Boffa et al., Jun. 21, 2007, discloses a method for reducing catalyst poisoning in exhaust after treatment systems. The lubricant may contain overbased detergent and succinimides and contains no more than 0.12 weight percent phosphorus. Rust inhibitors include nonionic polyoxyethylene surface active agents; metal deactivators include triazole derivatives; demulsifiers include polyoxyethylene alkyl ether; foam inhibitors include alkyl methacrylate polymers.

U.S. Publication 2012-0132166, Andoh et al., May 31, 2012, discloses a lubricating composition for automotive engines containing a nitrogen-containing ashless dispersant, an alkaline earth metal-containing detergent, and other components. Auxiliary additives include benzotriazol compounds, . . . nonionic polyoxyalkylene surface active agents such as . . . copolymers of ethylene oxide and propylene oxide functioning as rust inhibitor and anti-emulsifying agent. In an example, a dispersant is prepared by thermally reacting a highly reactive polyisobutene containing at least approx. 50% of methylvinylidene structure with maleic anhydride.

WO 2012/03537, Greaves et al., Mar. 8, 2012, discloses corrosion inhibiting polyalkylene glycol-based lubricant compositions for use in extreme conditions such as those experienced in wind turbine gearboxes. The lubricant may comprise, among other components, a random or block copolymer polyalkylene glycol based on ethylene oxide and propylene oxide; a polyalkylene [sic] homopolymer having propylene oxide or butylene oxide units. It may contain a yellow metal passivator which may be, e.g., tolutriazole. It may contain a corrosion inhibitor such as an alkenyl succinic acid half ester in mineral oil.

SUMMARY OF THE INVENTION

The disclosed technology provides a method for lubricating a sump-lubricated, compression-ignited stationary gas engine wherein the engine drives a compressor and wherein both the engine and the compressor are lubricated with the same lubricant, comprising supplying to said engine a lubricant comprising: (a) an oil of lubricating viscosity; (b) 0.02 to 2.0 percent by weight a polyether of number average molecular weight 1000 to 10,000; said polyether comprising alkylene oxide monomer units, where the alkylene group contains 3 to 6 carbon atoms, and ethylene oxide monomer units; and (c) 10 to 300 parts per million by weight of one or more anti-foam agents; wherein said lubricant has a sulfated ash content of less than 0.7 percent.

In another embodiment the lubricant may comprise (a) an oil of lubricating viscosity; (b) about 0.2 to about 2.0 percent by weight a polyether of number average molecular weight about 1000 to about 10,000; said polyether comprising alkylene oxide monomer units, where the alkylene group contains 3 to 6 carbon atoms, and ethylene oxide monomer units; and (c) about 3 to about 80 parts per million by weight of one or more silicon-containing anti-foam agents; wherein said lubricant has a sulfated ash content of less than about 0.7 percent.

The disclosed technology further provides the lubricant as thus described, and also provides a lubricant comprising (a) an oil of lubricating viscosity; (b) a polyether; and (c); an ashless polyalkylene succinimide dispersant, optionally derived from polyisobutylene having at least about 50 percent terminal vinylidene groups; said lubricant having a sulfated ash content of less than about 0.7 percent.

DETAILED DESCRIPTION OF THE INVENTION

Various preferred features and embodiments will be described below by way of non-limiting illustration.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials that are normally understood to be present in the commercial grade.

One element of the present technology is an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is provided in paragraphs [0058] to [0059] respectively of WO2008/147704. Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be selected from any of the base oils in Groups I-V as specified in the American Petroleum Institute (API) Base Oil Interchangeability Guidelines. The five base oil groups are as follows: Group I: >0.03% sulfur and/or <90% saturates and viscosity index 80 to 120; Group II: ≤0.03% S and ≥90% saturates and VI 80 to 120; Group III: ≤0.03% S and ≥90% saturates and VI>120; Group IV: all polyalphaolefins; Group V: all others. Groups I, II and III are mineral oil base stocks. In one embodiment, the oil of lubricating viscosity may be or comprise an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed hereinabove) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

One component of the disclosed technology is a polyether. Polyethers generally may comprises a polyether, a polyetheramine, or mixtures thereof. Polyethers may be represented by Formula I:

$$RO[CH_2CH(R^1)O]_xR^2$$

where R and $R^2$ are independently hydrogen or a hydrocarbyl group; $R^1$ may be hydrogen, an alkyl group of 1 to 14 carbon atoms, or mixtures thereof; and x may be a number from 2 to 50. In one embodiment R is a hydrocarbyl group and $R^2$ is hydrogen. The hydrocarbyl group R (and, optionally $R^2$) is typically a univalent hydrocarbon group having one or more carbon atoms, such as alkyl and alkylphenyl groups having 7 to 30 total carbon atoms, or 9 to 25, or 11 to 20 total carbon atoms. The repeating oxyalkylene monomer units (that is, the units represented by $[CH_2CH(R^1)O]$ in Formula 1) may be derived, for instance, from ethylene oxide, propylene oxide, or butylene oxide, or mixtures thereof. The number of oxyalkylene units x may be 10 to 35, or 18 to 27. If $R^1$ is an alkyl group, it may appear as a substituent on either of the two carbon atoms shown in the above formula and may differ in its location on various repeat units. The polyether can be prepared by various well-known methods including condensing one mole of an alcohol or alkylphenol (either a monool or a diol) with two or more moles of an alkylene oxide, mixture of alkylene oxides, or with several alkylene oxides in sequential fashion, usually in the presence of a base catalyst. U.S. Pat. No. 5,094,667 provides reaction conditions for preparing a polyether. Suitable polyethers are commercially available from Dow Chemicals, Huntsman, ICI and include the Actaclear® series from Bayer.

Polyetheramines can be represented by the formula $R[OCH_2CH(R^1)]_nA$ where R is a hydrocarbyl group as described above for polyethers; $R^1$ is hydrogen, an alkyl group of 1 to 14 carbon atoms, and mixtures thereof n is a number from 2 to 50; and A is $—OCH_2CH_2CH_2NR^3R^3$ or $—NR^4R^4$ where each $R^3$ is independently hydrogen or a hydrocarbyl group of one or more carbon atoms, and each $R^4$ is independently hydrogen, a hydrocarbyl group of one or more carbon atoms, or $—[R^5N(R^6)]_pR^7$ where $R^5$ is $C_2$-$C_{10}$ alkylene, $R^6$ and $R^7$ are independently hydrogen or a hydrocarbyl group of one or more carbon atoms, and p is a number from 1 to 7. The polyetheramine may be derived from ethylene oxide, propylene oxide, or butylene oxide. The number of oxyalkylene units, n, in the polyetheramine may be 10 to 35, or 18 to 27. A polyether derived from an alcohol or alkylphenol as described above can be condensed with ammonia, an amine or a polyamine in a reductive amination to form a polyetheramine as described in European Publication EP 310875.

In the case of the disclosed technology, a lubricant will contain a polyether comprising alkylene oxide units, wherein the alkylene group contains 3 to 6 carbon atoms, and ethylene oxide monomer units. The alkylene group may be propylene, butylene, pentylene, or hexylene, or mixtures thereof and typically they are the 1,2-isomers. Thus, in terms of Formula 1, the ethylene oxide monomer units will have $R^1$=H and the higher alkylene oxide groups will have $R^1$=methyl, ethyl, propyl, or butyl, respectively.

In one embodiment the polyether may be a copolymer of ethylene oxide and propylene oxide. In certain embodiments the polymer comprises 5 to 95 weight percent ethylene oxide monomer units and the balance other specified alkylene oxide units, typically propylene oxide monomer units; alternatively there may be 5 to 90, or 10 to 70, or 12 to 50, or 14 to 30, or 15 to 20 weight percent ethylene oxide monomer units, and the balance propylene oxide or other alkylene oxide (calculated exclusive of any hydrocarbyl end groups R or $R^2$).

In certain embodiments, the polyether as shown in Formula 1 is a monohydroxy compound, that is, $R^2$ is H and R is an alkyl group such as The number average molecular weight of the polyether will typically be 1000 to 10,000, or 2000 to 9000, or 3000 to 8000, or 4000 to 6000. The amount of this polyether will typically be 0.02 to 0.5 weight percent of the lubricant, or alternatively 0.02 to 0.2, or 0.03 to 0.1, or 0.03 to 0.08 weight percent, or, in other embodiments, 0.05 to 025, or 0.1 to 0.2, or 0.13 to 0.18 percent by weight of the lubricant.

In addition to the above-described polyether, there may optionally be present a second polyether. This second polyether will be of similar general structure and properties as described above, except, however, that it may contain less than 5 weight percent ethylene oxide monomer units, or less than 2 or less than 1 weight percent. The remainder of the monomer units will be alkylene oxide monomer units as described above, typically propylene oxide units. In one embodiment, the optional second polyether may be a polypropylene oxide. Its molecular weight may be 300 to 5000, or 500 to 4000, or 800 to 3000, or 1000 to 2000.

The amount of the second, optional polyether may be up to 0.5 percent by weight, e.g., 0.05 to 0.5 percent, or 0.08 to 0.3, or 0.1 to 0.2 percent.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group," including permissible amounts of other atoms, is found in paragraphs [0118] to [0119] of International Publication WO2008147704 as well as paragraphs [0137] to [0141] of published application US 2010-0197536.

The lubricant of the disclosed technology will also contain 10 to 300 parts per million, or 20 to 200, or 20 to 100, or 25 to 80, or 30 to 70 parts per million by weight, of an anti-foam agent. In one embodiment the antifoam agent may include 3 to 80 parts per million by weight (or 5 to 70, or 10 to 60, or 20 to 50 ppm) of one or more silicon-containing antifoam agents. In one embodiment there is no silicon-containing anti-foam agent present, that is, less than 3 or 2 or 1 parts per million. In one embodiment the lubricant may contain a non-silicon-containing antifoam agent (which may be referred to as a silicon-free anti-foam agent). The amount of this agent may be 10 to 300 or 10 to 200 or 20 to 100 or 25 to 80 or 30 to 70 parts per million.

The silicon-free polymeric antifoam agent may comprise an alkyl acrylate polymer, such as a copolymer of ethyl acrylate and 2-ethylhexyl acrylate. Such materials are commercially available. Silicon antifoam agents may be fluorinated molecules, or molecules without fluorine, or mixtures of such molecules. Such materials are also commercially available and includes such species as polydimethylsiloxane and trimethyl, trifluoropropylmethyl siloxane. Antifoam materials may be provided commercially as oil-diluted compositions; the amounts reported herein are an oil-free basis.

At least a small amount of an antifoam agent is desirable to minimize foaming while the lubricant is lubricating the engine. However, an excessive amount may be deleterious to the anti-emulsion performance of the lubricant as it may be used for the lubrication of a compressor.

Another component in the disclosed technology may be a dispersant. Dispersants are well known in the field of lubricants and include what are known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 0.5 to 10 weight percent, 0.5 to 6, or 1.5 to 9 or to 6 or to 4 percent by weight.

A succinimide dispersant may also be obtained/obtainable from a chlorine-assisted process, often involving Diels-Alder chemistry, leading to formation of carbocyclic linkages from the hydrocarbon chain to the succinic moiety. The process is known to a person skilled in the art. The chlorine-assisted process may produce a dispersant that is a polyisobutylene succinimide having a carbocyclic ring present on 50 mole % or more, or 60 to 100 mole % of the non-borated dispersant molecules. Both the thermal and chlorine-assisted processes are described in greater detail in U.S. Pat. No. 7,615,521, columns 4-5 and preparative examples A and B.

Alternatively, a succinimide dispersant may be prepared/obtained/obtainable from reaction of succinic anhydride by an "ene" or "thermal" reaction, by what is referred to as a "direct alkylation process." The "ene" reaction mechanism and general reaction conditions are summarized in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present of less than 50 mole %, or 0 to less than 30 mole %, or 0 to less than 20 mole %, or 0 mole % of the non-borated dispersant molecules. The "ene" reaction may have a reaction temperature of 180° C. to less than 300° C., or 200° C. to 250° C., or 200° C. to 220° C. The polyisobutene particularly useful in preparing an "ene" type succinimide dispersant may desirably have at least 50 percent terminal vinylidene groups, such as at least 60, or 70, or 80 percent.

In certain embodiments, the succinimide dispersant prepared by the "thermal" or "ene" route may be particularly useful. In other embodiments, the succinimide dispersant prepared by the chlorine-assisted route may be particularly useful.

The disclosed lubricant may optionally contain a metal-containing detergent. The metal-containing detergent which may be present as an additive component in the lubricant is, in one embodiment, an overbased detergent. It may, alternatively, be a neutral detergent. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound (in this instance, a hydrocarbyl-substituted salicylic acid), a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Overbased detergents are often characterized by Total Base Number (TBN). TBN is the amount of strong acid needed to neutralize all of the overbased material's basicity, expressed as potassium hydroxide equivalents (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present invention typically have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc or cadmium. In one embodiment the Group 2 metals are magnesium, calcium, barium, or zinc, and in another embodiments magnesium or calcium. In certain embodiments the metal is calcium or sodium or a mixture of calcium and sodium. Generally the metal compounds are delivered as metal salts. The anionic portion of the salt can be hydroxide, oxide, carbonate, borate, or nitrate.

In one embodiment the lubricants may contain an overbased sulfonate detergent. Oil-soluble sulfonates can be represented by one of the following formulas: $R^2$-T-$(SO_3)_a$ and $R^3$—$(SO_3$—$)_b$, where T is a cyclic nucleus such as typically benzene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. In one embodiment the sulfonate detergent may be a predominantly linear alkylbenzenesulfonate detergent having a metal ratio of at least 8 as described in paragraphs [0026] to [0037] of US Patent Application 2005-065045.

Another overbased material which can be present is an overbased phenate detergent. The phenols useful in making phenate detergents can be represented by the formula $(R^1)_a$—Ar—$(OH)_b$, wherein $R^1$ is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there is an average of at least 8 aliphatic carbon atoms provided by the $R^1$ groups for each phenol compound. Phenate detergents are also sometimes provided as sulfur-bridged species. In some embodiments, the phenate detergent contains less than 20% or less than 10% or less than 5% or less than 2% or less than 1%, e.g., 0 or 0.05% to 0.5% of monomeric para-dodecylphenol or sulfurized monomer thereof or salt thereof, based on the active chemical amount of the phenate detergent. Methods for preparing phenolic dispersants of this type are disclosed in numerous applications or publications, including PCT/US2012/060839, PCT/US2013/024877, and U.S. Pat. No. 7,435,709.

In one embodiment, detergent may comprise a salicylate detergent such as an overbased calcium hydrocarbyl-substituted salicylate detergent. The presence of a salicylate detergent may be beneficial in providing oxidation resistance to the lubricant. In one embodiment the salicylate detergent has a Total Base Number of about 200 to about 700 on an oil free basis, that is, factoring out the effect of diluent oil. Salicylate detergents are known; see, for instance, U.S. Pat. Nos. 5,688,751 or 4,627,928.

In one embodiment, the overbased material is an overbased saligenin detergent. Overbased saligenin detergents are commonly overbased magnesium salts which are based on saligenin derivatives. Saligenin detergents are disclosed in greater detail in U.S. Pat. No. 6,310,009, with special reference to their methods of synthesis (Column 8 and Example 1) and suitable amounts of the various species of X and Y (Column 6).

Salixarate detergents may also be present. Salixarates and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Other overbased detergents can include overbased detergents having a Mannich base structure, as disclosed in U.S. Pat. No. 6,569,818.

Either a single detergent or multiple additional detergents can be present. The amount of the detergent or detergents (individually or in total) in the lubricants of the present technology may be 0.5 to 5 percent by weight, or 1 to 3 percent. The amount in a concentrate will be correspondingly higher. The total amount of detergents present in the lubricants of the disclosed technology may be an amount suitable to provide 1 to 5 TBN, or 2 to 4, or 2.5 to 3 TBN to the lubricant.

The present technology is particularly useful also when the total sulfated ash of a lubricant is relatively low, for instance, less than 1% or less than 0.8% or less than 0.7 percent, e.g., 0.01 to 0.8, or 0.1 to 0.75, or 0.2 to 0.7 percent.

Another component that may be included in the lubricant is a corrosion inhibitor (which may also function as a rust inhibitor or a metal deactivator). Corrosion inhibitors typically may include nitrogen-containing materials such as triazoles and thiadiazoles and derivatives thereof. Suitable triazoles include aromatic triazoles such as benzotriazole or alkylbenzotriazoles such as tolutriazole.

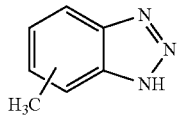

(methyl-1-H-benzo[d][ 1,2,3]triazole or tolutriazole) Thiadiazoles include dimercaptothiadiazoles and mono- or di-alkyl derivatives of dimercaptothiadiazoles.

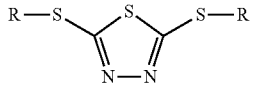

(including species with multiple S atoms in a chain). The amount of the corrosion inhibitor (such as the amount of the aromatic triazole) may be 0.001 to 0.1 percent by weight, or 0.003 to 0.03 percent, or 0.005 to 0.1 percent.

Additional conventional components may be used in preparing a lubricant according to the present technology, for instance, those additives typically employed in a crankcase lubricant. Crankcase lubricants may typically contain any or all of the following components hereinafter described.

One component is an antioxidant, sometimes referred to as an ashless antioxidant if it is desired to distinguish metal-containing materials from metal-free (ashless) compounds. Antioxidants encompass phenolic antioxidants, which may comprise a butyl substituted phenol containing 2 or 3 t-butyl groups. The para position may also be occupied by a hydrocarbyl group or a group bridging two aromatic rings. They may also contain an ester group at the para position, for example, an antioxidant of the formula

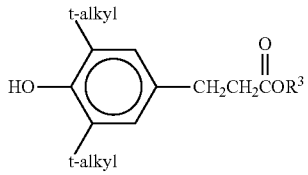

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105. Antioxidants also include aromatic amines, such as nonylated diphenylamines. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Viscosity improvers (also sometimes referred to as viscosity index improvers or viscosity modifiers) may be included in the disclosed compositions. Viscosity improvers are usually polymers, including polyisobutenes, polymethacrylic acid esters, diene polymers, polyalkylstyrenes, esterified styrene-maleic anhydride copolymers, alkenylarene-conjugated diene copolymers and polyolefins. Multifunctional viscosity improvers, which also have dispersant and/or antioxidancy properties are known and may optionally be used. Viscosity improvers may be used at, e.g., 0.1 to 0.8 percent or 0.3 to 0.6 percent by weight.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. The present technology is particularly useful for formulations in which the total amount of phosphorus as delivered by various components including the antiwear agent, does not exceed 0.075% or 0.07% or 0.06%. Suitable amounts may include 0.005 to about 0.055 percent by weight or 0.01 to 0.05 percent or 0.02 to 0.05 percent. Often the antiwear agent is a zinc dialkyldithiophosphate (ZDP). For a typical ZDP, which may contain 10 percent P (calculated on an oil free basis), suitable amounts may include 0.05 to 0.6 or 0.05 to 0.55 or 0.1 to 0.5 or 0.2 to 0.5 percent by weight, thus contributing phosphorus in corresponding amounts, such as up to 0.075 weight percent or 0.005 to 0.06 weight percent, or other amounts as described above. Non-phosphorus-containing anti-wear agents, which may also be used, include borate esters (including borated epoxides), dithiocarbamate compounds, molybdenum-containing compounds, and sulfurized olefins.

Other additives that may optionally be used in lubricating oils include pour point depressing agents, extreme pressure agents, anti-wear agents, and color stabilizers.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present technology; the present technology encompasses the composition prepared by admixing the components described above.

Examples

Example 1

Reference

A low-ash stationary-gas engine lubricant is prepared comprising an oil of lubricating viscosity, 2.54 wt. % of a succinimide dispersant (chlorine-route); 0.74 wt. % of overbased Ca sulfonate detergent(s); 0.97 wt. % overbased Ca phenate detergent(s), 0.27 wt. % zinc dialkylthiophosphate(s); 2.85 wt. % antioxidants (phenolic, aminic, and/or sulfurized olefin); 0.35 wt. % of a borate ester, and 0.007 percent by weight of polydimethylsilixane antifoam agent (commercial material, about 10% in oil, corresponding to 7 ppm antifoam agent on an active chemical basis).

Example 2

The formulation of Example 1 is repeated, with the following compositional changes: An additional 0.78 wt. % succinimide dispersant is added (a thermal or direct alkylation material); the amount of overbased Ca sulfonate detergent(s) is reduced to 0.66 wt. %, the amount of overbased Ca phenate detergent(s) is reduced to 0.91 wt. % (and the specific blend of both detergents is altered slightly), and a different specific mixture of zinc dialkyldithiophosphates is used (total amount 0.28 wt. %). Also, to the formulation of Example 2 is added 0.1 wt. % of a polypropylene oxide, molecular weight about 1400, initiated by a C12-15 alcohol; and 0.0075 weight percent tolutriazole.

The formulations of Example 1 and Example 2 are subjected to a high temperature corrosion bench test (HTCBT, ASTM D 6594). The test is run for 168 hours at 135° C., and the drain oil is evaluated at the end of the test for copper corrosion (by ICP). The formulation of Example 1 exhibits 138 ppm copper; that of Example 2 exhibits only 75 ppm copper.

The formulations of Example 1 and Example 2 are subjected to the Indiana Stirrer Oxidation Test (ISOT). This test evaluates the thermal and oxidative stability of a fluid. A 250 mL test sample is stirred at 165° C. for 148 hours in the presence of a copper coupon and an iron coupon. At the end of the test, change of viscosity, change of acidity (as TAN) and change of basicity (as TBN) are measured and reported.

For the material of Example 1, at the end of the test the viscosity at 100° C. is increased by 10.7%, compared with only 3.2% for Example 2. The viscosity at 40° C. is increased by 18.9%, compared with only 6.0% for Example 2. The increase in acidity in Example 1 is by 3.6 TAN units (mg KOH/g), versus only 0.7 increase for Example 2. The basicity at the end of the test (by ASTM D2896) is 0.5 TBN units (mg KOH/g) for Example 1 but 2.2 units for Example 2.

The presence of one or more of the tolutriazole, the polypropylene oxide, and the thermal-process dispersant leads to reduced copper corrosion, reduced viscosity increase, reduced acidity formation, and better base retention in Example 2.

The lubricants of both Example 1 and Example 2, however, exhibit a deficiency under certain conditions when they are sued to lubricate a stationary gas engine which powers a multi-stage compressor, lubricated by the same lubricant. It is found that, in particular, when the compressor us used to lubricate a natural gas compressor, and the natural gas contains condensable materials such as water, an emulsion may be formed in the lubricant which may interfere with the optimal operation of the compressor. In order to evaluate the emulsion formation, the lubricants of Example 1 and Example 2, as well as several further examples, are evaluated by the demulsibility test described in ASTM D 1401. In this test, the oil sample and distilled water are stirred together for 5 minutes at 82° C. in a graduated reparatory funnel. The amount emulsion remaining in mL (out of an initial 80 mL emulsion) is measured and reported as a function of time (minutes). The formulations and their demulsification results are presented in the following table.

| | time, minutes | | | | | | | |
|---|---|---|---|---|---|---|---|---|
| Composition; | 0 | 5 | 10 | 15 | 20 | 25 | 30 | 60 |
| Ex. 1* | 80 | 79 | 79 | 79 | 79 | 79 | 79 | 78 |
| Ex. 2 | 80 | 80 | 80 | 79 | 79 | 79 | 79 | 79 |
| Ex. 3 (=Ex 2 + 0.05% polyether B + 0.01% antifoam D) | 80 | 80 | 80 | 80 | 80 | 80 | 79 | 79 |

-continued

| Composition; | time, minutes 0 | 5 | 10 | 15 | 20 | 25 | 30 | 60 |
|---|---|---|---|---|---|---|---|---|
| Ex. 4 (=Ex. 2 + 0.05% polyether A) | 80 | 40 | 37 | 35 | 34 | 32 | 31 | 30 |
| Ex. 5 (=Ex. 2 + 0.05% polyether A + 0.01% antifoam C) | 80 | 31 | 29 | 29 | 29 | 29 | 29 | 24 |
| Ex. 6 (=Ex 2 + 0.05% polyether A + 0.02% antifoam C) | 80 | 36 | 36 | 36 | 34 | 33 | 28 | 22 |
| Ex. 7 (=Ex 2 + 0.10% polyether A + 0.01% antifoam C) | 80 | 50 | 50 | 47 | 47 | 47 | 47 | 46 |
| Ex. 8 (=Ex 2 + 0.05% polyether A + 0.01% antifoam E | 80 | 75 | 75 | 75 | 75 | 75 | 75 | 75 |

*A reference or comparative example

Polyether A = an ethylene oxide/propylene oxide copolymer, about 16 weight percent ethylene oxide units, believed to have a molecular weight about 3800.

Polyether B = an additional amount of polypropylene oxide, molecular weight about 1400, initiated by a C12-15 alcohol, that is, the same polyether present in Example 2.

Antifoam C = copolymer of ethyl acrylate and 2-ethylhexyl acrylate (weight ratio 29:71), Mn about 10,000 to 100,000. This material contains about 69% oil or solvent; the amount reported is oil-containing.

Antifoam D = additional antifoam agent of the type used in Ex. 1 and Ex. 2; amount listed contains the 90% diluent oil.

Antifoam E = trimethyl trifluoropropylmethyl siloxane; amount listed contains about 25% oil or solvent.

The results show that Examples 1 and 2 do not significantly demulsify even after 60 minutes of standing. Example 3 shows that addition of more of the polypropylene oxide already present in Example 2 and addition of more of the antifoam agent already present does not lead to improvement in demulsibility. However, Example 4 shows that addition of 0.5% of the ethylene oxide/propylene oxide copolymer leads to a significant and unexpected improvement in demulsification. Example 5 and 6 show further improvement when 0.01 to 0.02% of the non-silicon-containing antifoam agent is added (31 to 62 ppm diluent-free). Example 7 shows that improvement persists when 0.10% of the ethylene oxide/propylene oxide copolymer is added. Example 8, on the other hand, shows that when 0.01% of a silicon-containing antifoam agent is added (that is, 75 ppm solvent-free), the improvement in demulsibility is not so apparent. This suggests that the amount of silicon-containing antifoam agents may desirably be kept below 80 parts per million by weight, and in other embodiments up to 75 or up to 70 ppm.

Example 9

Reference

A low-ash stationary-gas engine lubricant is prepared comprising an oil of lubricating viscosity, 2.54 wt. % of a succinimide dispersant (chlorine-route); 0.66 wt. % of overbased Ca sulfonate detergent(s); 0.91 wt. % overbased Ca phenate detergent(s), 0.27 wt. % zinc dialkylthiophosphate(s); 2.0 wt. % antioxidants (phenolic, aminic, and/or sulfurized olefin); and 0.007 percent by weight of polydimethylsiloxane antifoam agent (commercial material, about 10% in oil, corresponding to 7 ppm antifoam agent on an active chemical basis).

Example 10

The formulation of Example 9 is repeated with the addition of 0.05 wt. % of the ethylene oxide/propylene oxide copolymer (Polyether A, defined above) and 0.01 wt. % of the non-silicon-containing antifoam agent (Antifoam C, defined above).

The formulations of Example 9 and Example 10 are subjected to the demulsibility test described in ASTM D 1401 and as described for Examples 1 and 2, except that the initial mixing/stirring is conducted at 54° C. The amount emulsion remaining in mL (out of an initial 80 mL emulsion) is measured and reported as a function of time (minutes). The formulations and their demulsification results are presented in the following table.

| Composition; | time, minutes 0 | 5 | 10 | 15 | 20 | 25 | 30 |
|---|---|---|---|---|---|---|---|
| Ex. 9* | 80 | 73 | 73 | 73 | 73 | 73 | 73 |
| Ex. 10 (=Ex 9 + 0.05% polyether A + 0.01% antifoam C) | 80 | 61 | 50 | 16 | 15 | 15 | 12 |

*A reference or comparative example

The results show that Example 9 does not significantly demulsify even after 30 minutes of standing. However, Example 10 shows that addition of 0.05% of the ethylene oxide/propylene oxide copolymer and 0.01% of the non-silicon-containing antifoam agent leads to a significant and unexpected improvement in demulsification.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a sump-lubricated, internal combustion stationary gas engine that is fueled by natural gas, wherein the engine drives a compressor and wherein both the engine and the compressor are lubricated with the same lubricant, comprising supplying to said engine a lubricant comprising:

(a) an oil of lubricating viscosity;

(b) about 0.02 to about 0.08 percent by weight a polyether, a polyetheramine, or mixtures thereof, of number average molecular weight about 1000 to about 10,000; said polyether, polyetheramine, or mixtures thereof comprising alkylene oxide monomer units, where the alkylene group contains 3 to 6 carbon atoms, and ethylene oxide monomer units;

(c) about 10 to about 300 parts per million by weight of one or more anti-foam agents, provided that the amount of silicon-containing antifoam agents is less than about 70 parts per million by weight; and (g) about 0.5 to about 5 percent by weight of a metal-containing detergent;

wherein said lubricant has a sulfated ash content of about 0.01 percent to less than about 0.7 percent; and wherein said lubricant is also used to lubricate the compressor that is driven by the engine.

2. The method of claim 1 wherein the polyether, polyetheramine, or mixtures thereof comprises propylene oxide monomer units and about 5 to about 95 weight percent ethylene oxide units.

3. The method of claim 1 further comprising (d) about 0.05 to about 0.5 percent by weight a polyether of number average molecular weight about 300 to about 5,000; said polyether comprising propylene oxide monomer units and less than about 5 weight percent ethylene oxide units.

4. The method of claim 1—wherein the anti-foam agent (c) comprises a non-silicon polymeric antifoam agent.

5. The method of claim 4 wherein the silicon-free polymeric antifoam agent comprises an alkyl acrylate polymer.

6. The method of claim 1 further comprising (f) about 0.5 to about 6 percent by weight of an ashless polyalkylene succinimide dispersant.

7. The method of claim 1 further comprising (h) about 0.001 to about 0.1 percent by weight of an aromatic triazole.

8. The method of claim 1 wherein the oil of lubricating viscosity comprises an API Group I oil.

9. The method of claim 1 wherein the compressor is a multiple stage compressor which includes at least one scrubber unit.

10. The method of claim 1 wherein the compressor is used to compress natural gas.

* * * * *